United States Patent [19]

Walter

[11] Patent Number: 4,489,580

[45] Date of Patent: Dec. 25, 1984

[54] METHOD FOR DEFORMING A FLAT SHEET METAL WORKPIECE

[75] Inventor: Siegfried Walter, Donauwörth, Fed. Rep. of Germany

[73] Assignee: Messerschmitt-Boelkow-Blohm Gesellschaft mit beschraenkter Haftung, Munich, Fed. Rep. of Germany

[21] Appl. No.: 523,340

[22] Filed: Aug. 15, 1983

[30] Foreign Application Priority Data

Aug. 26, 1982 [DE] Fed. Rep. of Germany ..... 3231673

[51] Int. Cl.[3] ..... B21D 31/06; B23P 17/00

[52] U.S. Cl. ..... 72/46; 29/424

[58] Field of Search ..... 29/423, 424, 527.2; 72/46; 427/156, 264, 265, 271, 409

[56] References Cited

U.S. PATENT DOCUMENTS

| | | | |
|---|---|---|---|
| 1,582,571 | 4/1926 | Budd | 29/423 X |
| 2,289,311 | 7/1942 | Wellman | 29/424 X |
| 2,960,763 | 11/1960 | Reichl | 29/423 |
| 2,960,764 | 11/1960 | Reichl | 29/424 |
| 3,524,243 | 8/1970 | McKowen et al. | 72/46 X |

*Primary Examiner*—E. Michael Combs

*Attorney, Agent, or Firm*—W. G. Fasse; D. H. Kane, Jr.

[57] ABSTRACT

A flat workpiece such as a sheet metal workpiece is deformed by impacting one surface of the workpiece with one or several impacting tools while supporting at least a portion of the workpiece surface opposite the impacted surface. In order to control the deforming impact effect for achieving the intended shape of the workpiece, the impact strength of uniform drive impulses is modified in accordance with the desired shape. For this purpose the impacts are damped in accordance with a predetermined surface pattern of impact strengths corresponding to the desired shape. Such damping is accomplished by coating the workpiece surface prior to the impacting with a damping layer or layers having a different damping effect in different places on the surface of the workpiece in accordance with the mentioned pattern, whereby the uniform impact strength is modified in its effect in accordance with the pattern over the surface of the workpiece.

8 Claims, 3 Drawing Figures

METHOD FOR DEFORMING A FLAT SHEET METAL WORKPIECE

BACKGROUND OF THE INVENTION

The invention relates to a method for shaping a workpiece or changing the shape of a workpiece such as a flat plate-like workpiece, for example a sheet metal workpiece.

In known reshaping methods of this type, the workpiece is locally stretched by plastic deformation in the upper or outer surface zones which are impinged upon so that the workpiece is arched convexly against the direction of impingement. Such methods use the shot peening method. It has also been suggested, but not published before the priority date of the present application, to use an impacting stamp which has an elongated effective surface and which is periodically driven by impulses effective on a pulse operated impact piston, and which is guided in a directionally stable manner along an impact line on the upper surface of the workpiece. The impact stamping method has the advantage that it attains a directional deformation effect, especially in the production of workpieces having a simple bent configuration. Therefore the impact method is preferred over the shot peening method. If the workpiece to be shaped comprises a non-uniform wall thickness and/or is to be bent at various radii of curvature, the deformation effect of the impact body or bodies in this method must be altered or varied in a complicated manner at the corresponding surface zones of the workpiece. Such a variation may be achieved by altering the motion impulses supplied to the impact body or bodies, or by altering the impact rate or density, or the advance or feed velocity of the tool and/or workpiece, which requires a structurally complicated impact body control, and therefore makes the practical application of said impacting method much more difficult or even impossible.

OBJECTS OF THE INVENTION

In view of the above it is the aim of the invention to achieve the following objects singly or in combination:

to develop the above mentioned method so as to achieve in a simple manner, an impact body deformation effect, which varies over the work surface, so that even workpieces with a non-uniform wall thickness and/or a non-uniform curvature may be easily shaped with little expense yet with a high precision;

to vary the effect of the shaping impulse or impact rather than the impact itself;

to dampen the impact to different degrees in different surface areas of the workpiece;

to use a reusable elastomeric damping layer for damping the shaping impacts;

to guide an impacting stamp by means of guide rollers;

to substantially avoid jamming of an impacting stamp;

to substantially avoid damaging the damping layer, so that it may be reused;

to make the spacing between a guide of an impacting stamp and a guide cylinder of an impact piston, driving the impacting stamp, adjustable or variable for selecting a required impacting strength for shaping a given workpiece; and to cover only certain surface portions of a workpiece with an impact damping material.

SUMMARY OF THE INVENTION

According to the invention there is provided a method for changing the shape of a plate-like, flat workpiece, especially a sheet metal part, in which the workpiece is impinged or impacted on one side by one or more intermittently driven locally limited impact body or bodies which act on the respective workpiece surface, which is coated before the impacting by a damping layer, which has a varying shock-absorbing characteristic according to the desired local deformation effect of the impact body or bodies. The damping layer may have a varying thickness or a varying density over the surface area and it may cover only a certain surface area in accordance with a given impacting pattern, which in turn depends on the desired final shape and material of the workpiece.

According to the invention, the deforming blow of the impact body or stamp, which is effective on the upper surface of the workpiece is variably controlled in the prescribed manner, in that a damping layer, which has a shock absorbing effect, is arranged between the impact stamp and the workpiece surface to which the impact is applied. The thickness or density of this damping layer varies locally corresponding to the required deformation effect and the elasticity and damping characteristic of the layer are variably chosen according to the existing wall thickness and according to the desired curvature or bending of the workpiece. This damping layer transmits a respectively exactly dosed portion of the motion impulse of the impacting stamp as a local deformation blow to the respective workpiece surface, the opposite surface of which is supported. This feature guarantees an exact adherence to surface zone deformation which varies over the work surface of the workpiece in accordance with a predetermined pattern so that it is possible for the first time, by means of the method according to the invention, to cost-effectively shape even complicated workpieces with a high precision by this impact body method, without additional costly control devices.

The damping layer is preferably an elastomeric layer with a greater layer thickness or greater damping effectiveness in areas of thinner wall thickness or in areas of less intended or final curvature of the workpiece than in other workpiece surface areas. Such a layer thickness or damping effectiveness may be achieved in a simple manner by an elastomeric lacquer, which may be applied onto the workpiece surface to be impacted as an appropriately areally stepped multiple lacquering. In other words, the damping layer will have different thicknesses in different areas in accordance with a desired pattern. It is recommendable, especially for larger production numbers, to construct the damping layer as a reusable elastomeric coating, for instance, by gluing over each other several damping films which have been cut to proper stepped sizes. In this way, several workpieces may be machined in succession with one and the same damping layer.

In the case that the reshaping is carried out by an impact stamp, which is provided with an elongated effective surface, which must be guided inthe stamp advance direction by means of a stamp guide, the stamp guide is supported by a roller guide rolling on the damping layer. This feature prevents the stamp guide from becoming jammed during the stamp advance by the workpiece upper surface or mainly by the damping layer, especially in the areas of increasing damping layer thickness. Thus, a very smooth and quiet advance of the impacting stamp is achieved.

For the same purpose, the impacting stamp is biased, preferrably by a spring, into a retracted position lifted away from the workpiece or damping layer upper surface, whereby the impacting stamp only comes into contact with the workpiece or damping layer for a short period of time for the duration of the deforming blow acting against the spring force. This feature, as opposed to a constant gliding support of the impacting stamp, largely eliminates the danger of jamming the impacting stamp or of damaging the damping layer.

The motion impulse applied to the impacting stamp, as already mentioned, does not have to be altered during the forming operation. Preferably, the impulse is preset to the maximum value required in the areas of the largest deformation effect, so that these areas of greatest wall thickness or greatest curvature of the workpiece may remain uncoated and so that the impact effect is damped only in the coated areas. The damping layer must then simply be dimensioned according to the required deviation range of the deforming blows.

The pre-selection of the motion impulse applied each time to the impacting stamp by an impact piston is preferably achieved in that the stamp guide is spaced a variable distance away from the guide cylinder of the impact piston. This distance is selected to be the larger, the larger the maximally required deformation effect of the impacting stamp becomes. This feature is a considerable simplification over the otherwise typical adjustment of the working pressure or of the stroke of the impact piston for pre-selecting the size of the motion impulse.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

The workpiece 2 to be shaped is initially a flat sheet metal plate, which is deformed by a hammer-like impacting, repetitively acting elongated impacting stamp 4. The impacting stamp 4 is moved back and forth over the workpiece surface at a consistent or constant advance speed perpendicularly to the desired direction of deformation of the sheet metal plate 2. After each pass of the impacting stamp 4, the sheet metal plate 2 is moved one step forward perpendicularly to the advance direction of the impacting stamp 4, so that rectilinear impact lines or tracks shown by dashed lines in FIG. 1 result. The value of the impact blow closeness or density of this impact line, in the movement direction of the impacting stamp 4 having a constant blow frequency, is determined by the chosen advance speed of the impacting stamp 4. The value of the line spacing between the adjacent impact lines is determined by the size of the step of the workpiece 2 perpendicularly to the advance direction of the impacting stamp 4. Both of these values are variably adjustable but remain constant during the machining or deforming. The impulse applied to the impacting stamp 4 for each impact blow also remains at a pre-selected constant value during a deforming operation.

Figure 1:
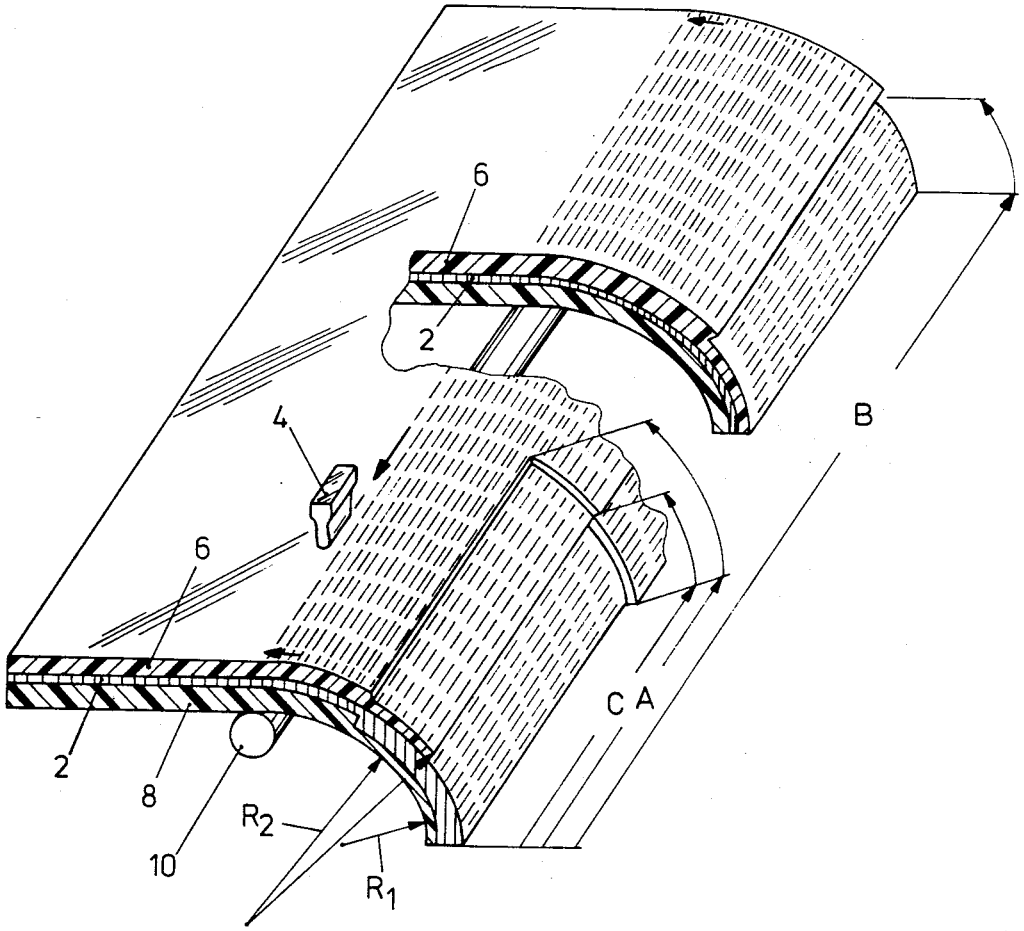
FIG. 1 is a partially sectional broken away perspective view of a plate-like sheet metal workpiece provided with a damping layer according to the invention during a deforming operation with an impacting stamp.

However, the sheet metal plate 2 or workpiece to be shaped has a non-uniform thickness, and is to be shaped at varying degrees of curvature. This is shown in FIG. 1, wherein the workpiece surface segment A of the workpiece 2 has an increased wall thickness relative to the other segments. The surface segment B is intended to have a smaller radius of curvature R, than the rest of the surface of the workpiece 2 having a radius of curvature $R_2$. Consequently, the required local deformation effect, or the local stretching of the outer surface zone of the workpiece 2 caused by the blows or impacts of the impacting stamp 4 is the highest in the overlap zone C of the two surface segments A and B, because the overlap zone C has the greatest wall thickness and the largest curvature. A weaker or smaller local deformation effect is required over the remaining portion of the surface segment A where the wall thickness remains just as great, but where the curvature is less, and over the thin-walled, yet sharply curved portion of the surface segment B. The lowest local deformation effect must be applied to all remaining surface areas of the workpiece 2, where the existing wall thickness as well as the required curvature is at a minimum.

In order to variably control the local deformation effect without having to alter the feed advance of the impacting stamp 4 and without varying the drive impulse applied thereto during the deforming operation, the workpiece 2 is covered or coated according to the invention by a damping layer 6 before the deforming operation. This damping layer 6 has a shock-absorbing characteristic which differs or varies over the various surface segments A, B, C. These different shock-absorbing characteristics are selected in accordance with the respective required local deformation effect. The damping layer 6 may be an elastomeric lacquer layer, of which the layer thickness decreases inversely to the required local deformation effect, whereby the workpiece surface areas, which have the greatest wall thickness and which are to be most sharply curved, e.g. the surface area C of the workpiece 2, remain uncoated. Such a construction of the damping layer 6 is most easily achieved through a multiple coating lacquering, in which appropriately dimensioned covering masks are applied to the surface areas of the workpiece 2 or the damping layer 6 which are not to be lacquered any thicker, before each separate lacquer coating is applied. Optionally, the damping layer 6 may be built up of multiple layers of single films which are appropriately cut to stepped sizes and glued over one another. Such multilayer or laminated damping layers may be removed from the workpiece surface after the deforming is completed and reused for further workpieces having the same characteristics.

Due to the varying layer thickness of the damping layer 6 the impact of the impacting stamp 4 is damped or cushioned to a greater or lesser degree in accordance with a pattern determined by the workpiece characteristics. In this way, the magnitude of the deforming blow acting on the workpiece surface is variably controlled during the deforming in the prescribed manner by the damping layer 6. The wall thickness and the thickness ratios of the damping layer 6, as well as the radii of curvature of the workpiece 2 have been greatly exaggerated in the Figs. for greater clarity.

The underside of the workpiece 2 is padded or lined over the full surface with a yielding material which levels out the wall thickness variations of the workpiece, for example a sheet or panel 8 of hard foam. The workpiece 2 and the hard foam sheet 8 rest during the tooling or machining on a pipe-shaped counter support body 10 located under the advance path of the impacting stamp 4.

Figure 2:
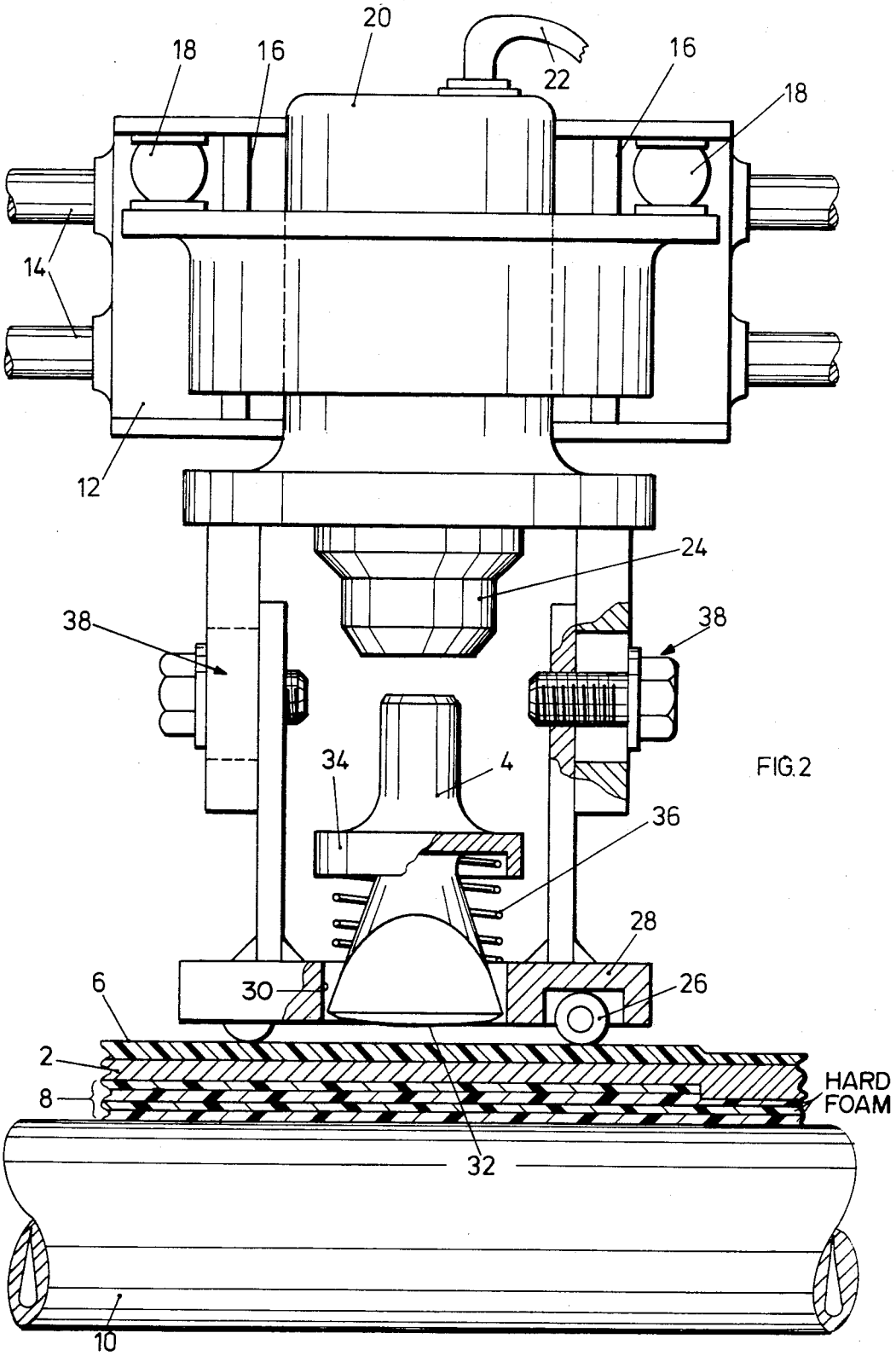
FIG. 2 is a partially sectional sideview of a machine tool for performing the present method.
Figure 3:
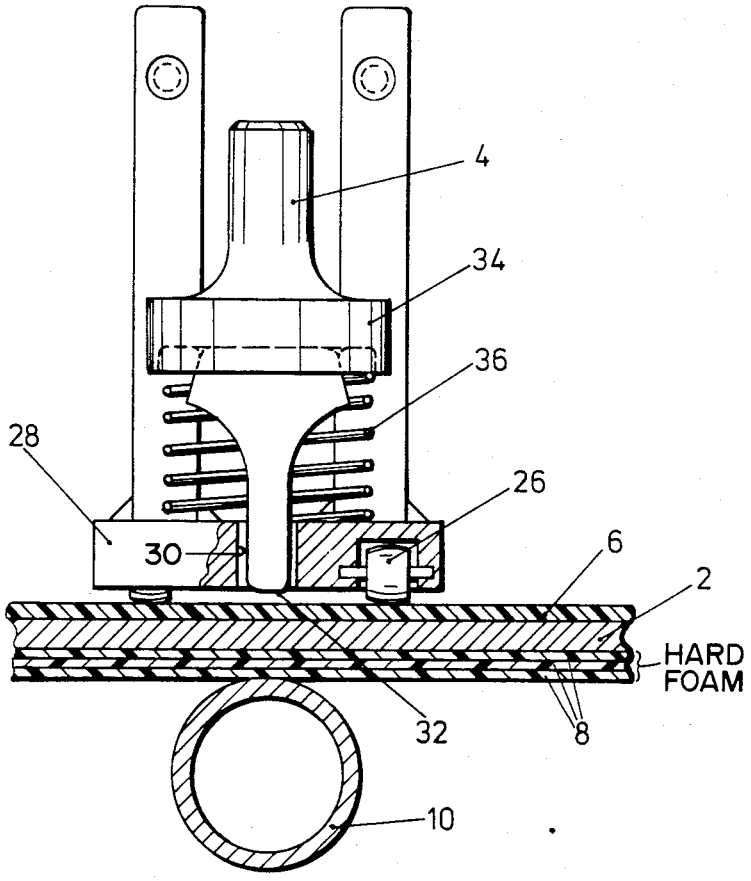
FIG. 3 is a partially sectional front view of the impacting stamp and of the impacting stamp guide of the machine tool shown in FIG. 2.

The machine tool shown in FIGS. 2 and 3 comprises, in addition to the impacting stamp 4, a tool carriage 12 as the major component, which is driven back and forth on guides 14 in the advance direction of the impacting stamp 4. An impact cylinder 20, including a compressed air supply 22 and an impact piston 24 which is periodically operated at a constant impact frequency in the manner of a riveting hammer, is vertically mounted in a slidable manner to the tool carriage 12 by guide bolts 16 and elastomeric springs 18. A guide shoe 28 provided with rollers 26 supports the impact piston cylinder unit 20, 24 on the surface of the workpiece 2 or on the damping layer 6. The impacting stamp 4 is guided in a perpendicularly slidable but non-rotatable manner in a slot-shaped cutout or recess 30 of the guide shoe 28. The impacting stamp 4 comprises an elongated, crowned effective surface 32 having a curvature increasing from the middle point toward the lengthwise sides as well as the narrow sides of the effective surface 32. A return spring 36 rests beween the guide shoe 28 and a circular collar 34 of the impacting stamp 4. The return spring 36 biases the impacting stamp 4 into the shown return stroke position in which the stamp is lifted away from the surface of the workpiece 2 or from the damping layer 6.

The machine tool shown offers a simple possibility for a variable pre-selection of the drive impulse applied to the impacting stamp 4 by the impact piston 24, in order to be able to deform various types of workpieces which require varying magnitudes of maximum value deforming blows, that is, varying magnitudes of the deformation effects are required on the coated and on the uncoated surface segments, but the maximum values are required on the uncoated segments. A height adjustable, oblong hole screw connection 38 is provided between the cylinder 20 and the guide shoe 28 for this purpose that is, for adjusting the drive impulse. The spacing between the impact cylinder 20 and the guide shoe 28 may be variably adjusted by means of the screw connection 38 prior to the deforming. If this spacing is pre-selected larger, then the free-flight travel of the impact piston 24 between its full return stroke position and its impacting on the impacting stamp 4 becomes larger. Correspondingly, the drive impulse supplied to the impacting stamp 4 in each work cycle of the impact piston 24 also becomes larger. Inversely, the drive impulse for driving the impacting stamp 4 against the workpiece surface or against the damping layer 6 decreases if a smaller spacing is selected or adjusted between the impact cylinder 20 and the guide shoe 28 prior to a deforming operation.

By means of the described method in practice, a large surface structural part, which is multiply stepped on its under surface and which comprises large relative wall thickness variations, is shaped into a simply curved contour, whereby after the damping layer 6 is removed, impact marks or tracks are clearly visible on the workpiece surface. However, such marks are easily removed by grinding, if desired.

Although the invention has been described with reference to specific example embodiments, it will be appreciated, that it is intended to cover all modifications and equivalents within the scope of the appended claims.

What is claimed is:

1. A method for deforming a flat workpiece such as a sheet metal workpiece by impact strokes applied to a surface of the workpiece while supporting the opposite workpiece surface, comprising the following steps, determining a surface pattern of the effective strengths of impacts of a tool required to be applied to one surface of the workpiece for shaping the workpiece, applying impact damping means to one surface of the workpiece, said impact damping means having damping characteristics which vary over the workpiece surface in accordance with said pattern, and applying a plurality of local deforming impacts impacts of uniform strength to the workpiece through said damping means for modifying the local deforming effect of said impacts over the entire surface of the workpiece.

2. The method of claim 1, further comprising applying a layer of elastomeric damping material to one surface of said workpiece, said layer of elastomeric damping material having different thicknesses relative to different workpiece surface areas covered by said layer in accordance with said pattern.

3. The method of claim 1, further comprising applying a layer of elastomeric damping material to one surface of said workpiece, said layer of elastomeric damping material having different densities relative to different workpiece surface areas covered by said layer in accordance with said pattern.

4. The method of claim 1, wherein said impacts are applied by a periodically impulse driven impact stamp having an elongated impacting surface, and roller guiding said impact stamp along an impact track on said impact damping means by means of a roller guide.

5. The method of claim 4, further comprising spring biasing said impact stamp into a rest position in which the impact stamp is out of contact with a workpiece.

6. The method of claim 4, further comprising impulse driving said impact stamp by means of an impact piston guided in a cylinder and arranging said roller guide and said cylinder with an adjustable spacing relative to each other, whereby the striking impulse applied to the impact stamp is preselectable by adjusting said spacing between said cylinder and said roller guide.

7. The method of claim 1, wherein said opposite workpiece surface is supported on a layer of hard foam material.

8. The method of claim 1, wherein certain workpiece surface areas remain uncovered.

* * * * *